United States Patent [19]

Gangl

[11] 4,177,910

[45] Dec. 11, 1979

[54] SHELL BOX HOLDING CLIP

[76] Inventor: William A. Gangl, 581 N. Hazel, St. Paul, Minn. 55119

[21] Appl. No.: 900,793

[22] Filed: Apr. 27, 1978

[51] Int. Cl.[2] ..... F42B 39/00

[52] U.S. Cl. ..... 224/252; 248/DIG. 5

[58] Field of Search ..... 224/17, 13, 14, 15, 224/20, 26 R, 26 B, 26 G, 5 R, 5 A, 5 MA, 5 H, 25 R; 248/DIG. 5, DIG. 7

[56] References Cited

U.S. PATENT DOCUMENTS

| | | | |
|---|---|---|---|
| D. 171,247 | 1/1954 | Charnota | 224/5 A UX |
| 1,139,779 | 5/1915 | Lenharth | 224/13 |
| 1,214,161 | 1/1917 | Hettinger et al. | 224/5 R |
| 2,155,760 | 8/1939 | Hy | 248/DIG. 5 UX |
| 2,315,573 | 4/1943 | Yaffa | 248/DIG. 5 X |
| 2,926,403 | 3/1960 | Weissman | 224/25 R UX |
| 3,091,378 | 5/1963 | O'Dwyer | 224/26 R |

*Primary Examiner*—Robert J. Spar
*Assistant Examiner*—Jerold M. Forsberg
*Attorney, Agent, or Firm*—William L. Huebsch

[57] ABSTRACT

A clip adapted for attaching a box of shotgun shells of any standard gauge or bore to a shooters belt or clothes in a readily accessible position. The clip comprises side by side inner and outer planar portions joined together along one common end and adapted to receive the front wall of a standard shotgun shell box therebetween, with a ledge portion at the end of the outer portion opposite its joined end engaging the bottom surface of the box. A hook portion projects from the outer portion of the clip and is adapted to hang the clip from the belt or clothes of a shooter.

6 Claims, 5 Drawing Figures

SHELL BOX HOLDING CLIP

BACKGROUND OF THE INVENTION

The present invention relates to devices for attaching a standard box of shotgun shells to a shooters belt or clothes.

It is common practice for participants in shooting games, such as trap or skeet, to dump a box of 25 shells to be used in the game into the pocket of a shooting jacket or into a bag attached to the shooters belt. Carrying shells in this manner, however, results in fumbling for loose shells in the pocket or bag which can detract from the concentration required for accurate shooting, and does not provide the shooter with an accurate indication of the number of shells remaining, which, if available, can signal certain information such as the proper time to switch stations on the range.

Open top containers (normally of leather), have been used which attach to a shooters belt and are shaped to closely receive a box of shells from which the top is removed. With such a container the shells are readily accessible and the amount of shells remaining can readily be determined. Such containers, however, are generally more expensive than may be desired, and (due to the difference in size between boxes of shells of different gauges or bores) are adapted to receive only boxes of shells of one gauge or bore.

SUMMARY OF THE INVENTION

The present invention provides an inexpensive efficient shell box holding clip which is adapted to attach a box of shotgun shells of any standard gauge or bore to the belt or clothes of the shooter with the shells in a readily accessible position.

The clip according to the present invention comprises side by side inner and outer planar portions joined along one end and adapted to receive one wall of a standard shotgun shell box therebetween (preferably its front wall) with the outer portion outside the box and extending full height along the wall of the box, and a ledge portion at the end of the outer portion opposite its end joined to the inner portion. The ledge portion projects from the side of the outer portion at which the inner portion is located and is adapted to engage the bottom surface of the box of shells. The inner portion has a part with a width generally the same as that of a box of shells, the clip is adapted to be accepted and located within a distance from the ledge portion equal to the height dimension of the box to restrict movement of the box (when the clip is engaged therewith) along the ledge portion transverse of the inner portion. Also the clip includes means for attaching it to a shooters belt or clothes which may comprise a hook-like portion projecting from the surface of the outer portion opposite the inner portion.

Preferably the inner and outer portions of the clip are integrally formed of a flexible resilient material to afford separating them and sliding them downwardly respectively along the inner and outer surfaces of the wall of a box of shells with the ledge portion moving along the outer surface of the wall until it leaves the wall and moves adjacent the bottom surface of the box.

Also, while the inner portion of the clip could have a width and height adapted to receive a box of shells of only one gauge or bore, preferably the inner portion of the clip is tapered in width from its end joining the outer portion toward its opposite end so that its width will be only slightly less than the width of the front wall of a box of shells of any standard gauge or bore at the distance from the ledge portion corresponding to the height of that box, thus providing a plurality of parts of the inner portion with widths generally the same as the widths of any standard size box of shotgun shells which will restrict movement of any one of such boxes with which the clip is engaged along the edge portion transverse of the inner portion.

BRIEF DESCRIPTION OF THE DRAWING

The present invention will be more thoroughly explained with reference to the accompanying drawing wherein like numbers refer to like parts in the several views, and wherein.

DESCRIPTION OF THE PREFERRED EMBODIMENT

Figure 1:
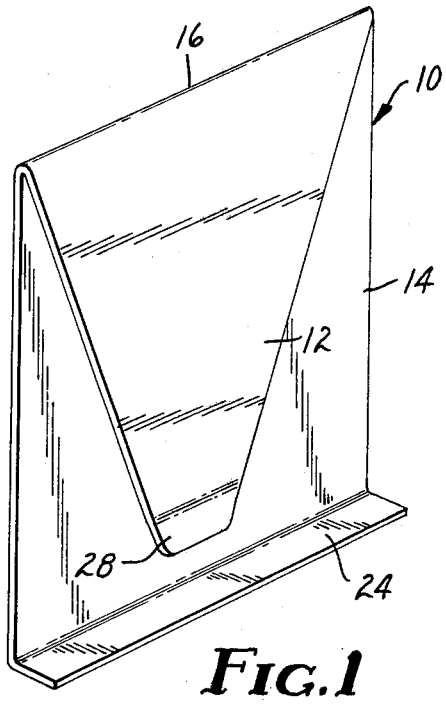
FIG. 1 is a perspective view of a shell box holding clip according to the present invention.

Referring now to the drawing there is shown a shell box holding clip according to the present invention generally designated by the reference numeral 10.

Figure 2:
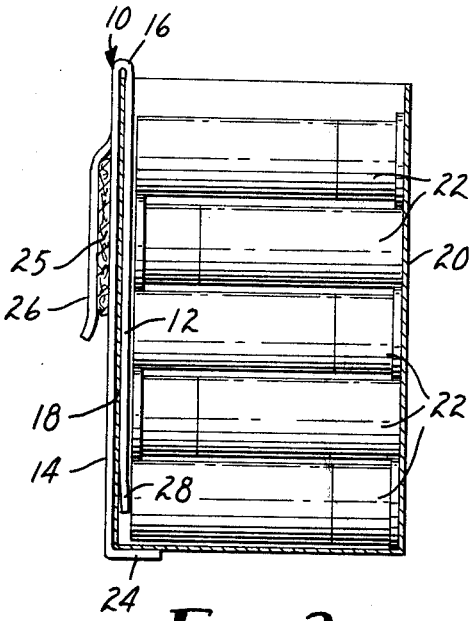
FIG. 2 is a vertical side view of the shell box holding clip of FIG. 1 shown attaching a sectioned box of shells to a belt.

The shell box holding clip 10 can be formed from one sheet of a flexible resilient material such as aluminum or steel, or could be molded of a stiff flexible resilient polymeric material. The clip 10 comprises side by side inner and outer adjacent planar portions 12 and 14 which are joined along one common end 16 and are adapted to receive a front wall 18 of a box 20 of shotgun shells 22 in close fitting engagement therebetween, with the inner and outer portions 12 and 14 biased against the adjacent surfaces of the wall 18, and with the rectangular outer portion 14 extending the full height of the front wall 18 from the bottom edge to the top edge of the box 20. The clip 10 also includes a rectangular ledge portion 24 at the end of the outer portion 14 opposite its end 16 joined to the inner portion 12. The ledge portion 24 projects at a right angle to the outer portion 14 from its side adjacent the inner portion 12, and is adapted to engage the lower surface of a box having its front wall received between the inner and outer portions 12 and 14. Also the clip 10 includes means for attaching it to a shooters clothes or belt 25 (FIG. 2) which, as illustrated, is a hook-like portion 26 projecting from the surface of the outer portion 14 opposite the ledge portion 24 and attached to the outer portion at its end opposite the ledge portion 24.

Figure 4:
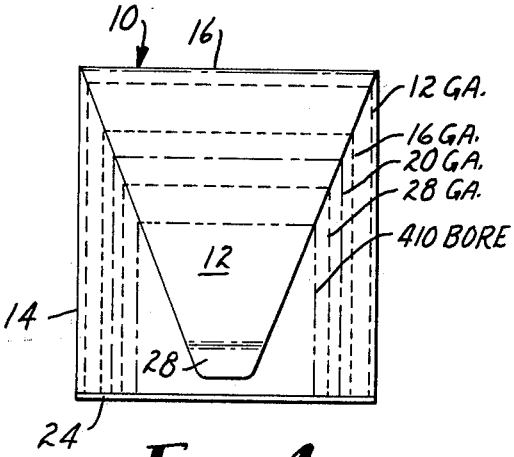
FIG. 4 is a reduced scale vertical front view of the shell box holding clip of FIG. 1 and phantom outlines of standard size boxes of various gauges and bores of shotgun shells that can be engaged with the clip.

The inner portion 12 extends the majority of the distance from its end 16 joining the outer portion 14 to the ledge portion 24, and preferably is generally triangular, being tapered in width from its end 16 joining the outer portion 14 toward its opposite end 28 so that its width will be only slightly less than that of the front wall of a box of shells of any standard gauge or bore at the distance from the ledge portion 24 corresponding to the height of that box. Thus the front wall of any standard box of shotgun shells can be engaged between the inner and outer portions 12 and 14 to the extent necessary to position the ledge portion 24 along its bottom surface, and the inner portion 12 will generally center the box along the edge portion 24, as is illustrated by boxes of shells in dotted outline shown in FIG. 4. For example the tapered inner portion 12 may have a width of about 10.1 centimeters (4 inches) at a distance of 10.5 centimeters ($4\frac{1}{8}$ inches) from the ledge portion 24 to accommodate 12 gauge shells; a width of about 9.5 centimeters ($3\frac{3}{4}$ inches) at a distance of 9.5 centimeters ($3\frac{3}{4}$ inches) from the ledge portion 24 to accommodate 16 gauge shells; a width of about 8.8 centimeters (3 7/16 inches) at a distance of 8.6 centimeters ($3\frac{3}{8}$ inches) from the ledge portion 24 to accommodate 20 gauge shells; and a width of about 6 centimeters ($2\frac{3}{8}$ inches) at a distance of 6.2 centimeters (2 7/16 inches) from the ledge portion 26 to accommodate 0.410 bore shotgun shells.

Also the narrow end 28 of the inner portion 12 helps to insert the inner portion 12 along the inside surface of the front wall of a box of shells adjacent the ends of the shells contained therein.

Figure 3:
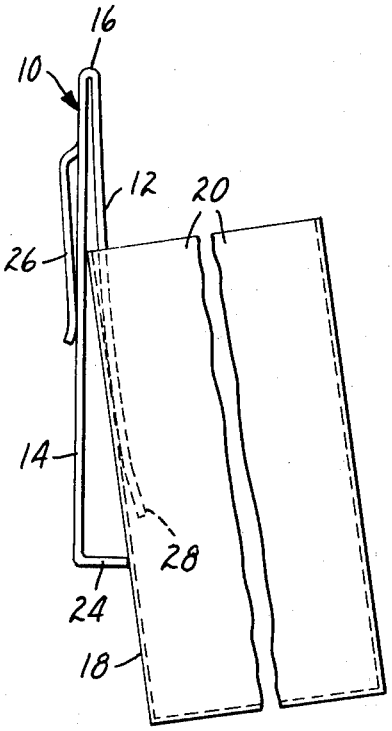
FIG. 3 is a vertical side view of the shell box holding clip of FIG. 1 shown during partial engagement of the clip with a box of shells.
Figure 5:
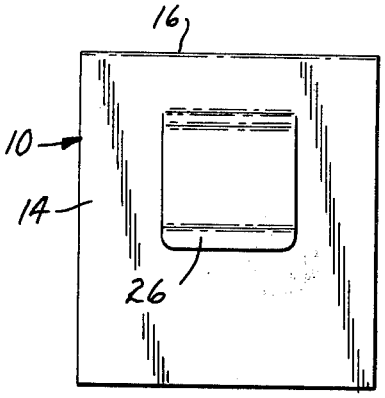
FIG. 5 is a reduced scale vertical back view of the shell box holding clip of FIG. 1.

To engage the clip 10 with a box of shells (such as the box 20), the top flaps of the box 20 are first either bent back or torn off to open the box. The outer edge of the ledge portion 24 is then positioned against the outer surface of the front wall 18 of the box 20 with the end 28 of the inner portion 12 adjacent its upper edge. The inner portion 12 is then separated from the outer portion 14 and positioned along the inner surface of the wall 18 as the clip 10 is pushed down along the wall 18. The clip 10 is pushed down with the ledge portion 24 sliding along the outer surface of the front wall 18 of the box 20 (see FIG. 3) until the ledge portion 24 engages under the bottom surface of the box 20 (see FIG. 2). The box 20 is now supported on the clip 10, and the clip 10 may be engaged with a shooters belt 25 or clothes via the hook-like portion 26.

I claim:

1. A shell box holding clip adapted to attach a standard box of shotgun shells to a shooter's belt or clothes and support the shells in a readily accessible position, wherein said clip comprises a planar outer portion adapted to extend full height along the wall of the box, an adjacent generally planar inner portion, joining means for joining adjacent ends of said inner and outer portions with said portions in face-to-face relationship and for resiliently biasing said inner and outer portions toward each other, a ledge portion at the end of the outer portion opposite its end joined to the inner portion which ledge portion projects from the side of the outer portion at which the inner portion is located and is adapted to engage the bottom surface of the box of shells, and means attached to said outer portion on its side opposite said ledge portion adapted for engagement with a shooter's belt or clothes; said inner portion extends the majority of the distance from said adjacent ends to said ledge portion; said joining means affords resilient separation and sliding of said inner and outer portions along opposite sides of one wall of the box with the ledge portion moved along its outer surface until the ledge portion moves along and is held adjacent the bottom surface of the box by the inner portion and the biasing of said joining means; and said inner portion has a part with a width generally the same as that of a said box located within a distance from said ledge portion equal to the height dimension of a said box to restrict movement of a said box with which the clip is engaged along said ledge portion transverse of said inner portion.

2. A shell box holding clip according to claim 1 wherein said inner portion is tapered from its end joining said outer portion toward its opposite end to provide a plurality of said parts of decreasing width at decreasing distances from said ledge portion to accommodate various standard size boxes of shotgun shells.

3. A shell box holding clip according to claim 2 wherein said box engaging portion has a width of about 10.1 centimeters at a distance of about 10.5 centimeters from said ledge portion to accommodate the front wall of a box of 12 gauge shotgun shells and a width of about 8.8 centimeters at a distance of about 8.6 centimeters from said ledge portion to accommodate the front wall of a box of 20 gauge shotgun shells.

4. A shell box holding clip according to claims 1 or 2 wherein said inner and outer portions are integrally formed of flexible resilient material joined along said common end to provide said joining means.

5. A shell box holding clip according to claims 1 or 2 wherein said inner and outer portions, said ledge portion and said hook portion are integrally formed of flexible resilient sheet material bent at about 180 degrees along said common end to provide said joining means, and bent at about 90 degrees between said outer portion and said ledge portion.

6. A shell box holding clip according to claims 1 or 2 wherein said means adapted for engagement with a shooters belt or clothes comprises a hook-like portion projecting from the side of said outer portion opposite said inner portion, and attached to said outer portion at its end opposite said ledge portion.

* * * * *